US007782287B2

(12) United States Patent
Hsiao

(10) Patent No.: US 7,782,287 B2
(45) Date of Patent: Aug. 24, 2010

(54) DATA ACCESSING INTERFACE HAVING MULTIPLEX OUTPUT MODULE AND SEQUENTIAL INPUT MODULE BETWEEN MEMORY AND SOURCE TO SAVE ROUTING SPACE AND POWER AND RELATED METHOD THEREOF

(75) Inventor: Ching-Fang Hsiao, Hsin-Chu (TW)

(73) Assignee: ILI Technology Corporation, Hsinchu County (TW)

( * ) Notice: Subject to any disclaimer, the term of this patent is extended or adjusted under 35 U.S.C. 154(b) by 854 days.

(21) Appl. No.: 11/552,513

(22) Filed: Oct. 24, 2006

(65) Prior Publication Data

US 2008/0094338 A1 Apr. 24, 2008

(51) Int. Cl.
*G09G 3/36* (2006.01)

(52) U.S. Cl. ..... 345/98; 345/87; 345/100

(58) Field of Classification Search ..... 345/55, 345/76, 77, 84, 87, 98, 99, 100, 204, 205, 345/206, 214, 690
See application file for complete search history.

(56) References Cited

U.S. PATENT DOCUMENTS 6,008,801 A 12/1999 Jeong
6,388,653 B1 * 5/2002 Goto et al. ..... 345/98
6,417,829 B1 7/2002 Jung
7,046,223 B2 * 5/2006 Hashimoto ..... 345/89
7,227,522 B2 * 6/2007 Fujimoto et al. ..... 345/87
2002/0080107 A1 * 6/2002 Fujimoto et al. ..... 345/87
2004/0155849 A1 8/2004 Bu
2004/0257328 A1 * 12/2004 Lim ..... 345/100

FOREIGN PATENT DOCUMENTS

CN 1378214 A 11/2002
CN 1530908 A 9/2004

* cited by examiner

*Primary Examiner*—My-Chau T Tran
(74) *Attorney, Agent, or Firm*—Rosenberg, Klein & Lee

(57) ABSTRACT

A data accessing interface between memory and source in LCD display IC includes a multiplex output module and a sequential input module. Suppose a row width of the memory is N bit. The multiplex output module is for outputting a row N-bit digital data. The multiplex output module includes a buffer for receiving the row N-bit digital data from the memory; and a multiplex unit for continuously selecting M bits from the N bit digital data to output to source. After N/M times, all of the row N bit digital data will be output to source. The sequential input module includes N latches and N/M latch control signals; when each latch control signal is active, it will latch M bit digital data from the multiplex output into M latches. After N/M latch control signals are active sequentially, the N bit digital data are stored into the N latches for source.

8 Claims, 6 Drawing Sheets

DATA ACCESSING INTERFACE HAVING MULTIPLEX OUTPUT MODULE AND SEQUENTIAL INPUT MODULE BETWEEN MEMORY AND SOURCE TO SAVE ROUTING SPACE AND POWER AND RELATED METHOD THEREOF

BACKGROUND OF THE INVENTION

1. Field of the Invention

The present invention relates to a data accessing interface, and more specifically, to a data accessing interface applied to an LCD display IC for saving routing space and power and related method thereof.

2. Description of the Prior Art

LCD monitors and related display apparatuses are small and light-weighted display devices, which can be found in many electronic products and are commonly applied to many fields nowadays. For example, in addition to aviation industry and medical equipment industry, they are utilized in portable communication devices, laptop computers, and digital cameras. The LCD monitors can offer flat, detailed, and high-resolution displays with high color contrast and high screen refresh rate. As to most of electronic products using the LCD monitors and having limited power provided by the battery devices, such as portable communication devices, how to provide LCD monitors with high power efficiency, low production cost, and smaller size to meet user's requirements has become a key issue of the future display apparatus development.

Please refer to FIG. 1. FIG. 1 is a block diagram of a data accessing system 100 in one prior art LCD display IC. The data accessing system 100 includes a data storage device 110 and a source device 120. The data storage device 110 comprises a memory 112 and a buffer unit 114, and the source device 120 has a source driver 122 and a buffer unit 124, wherein the buffer unit 114 contains a plurality of latches 114_1-114_*n* and the buffer unit 124 contains a plurality of latches 124_1-124_*n*. The memory 112 in the data accessing system 100 is used for storing digital data corresponding to color components R, G, B of each pixel. For instance, digital data associated with one color component R, G, or B of a pixel contain 6 bits. In other words, suppose that each row of the memory 112 stores digital data of 128 pixels. Because each pixel includes data of three color components R, G, and B, the bit number of digital data representative of each pixel is 18 (i.e., 6*3). Therefore, the bit number of each row in the memory 112 is 2304 (i.e., 128*18). In addition, the source driver 122 in the source device 120 refers to the pixel data provided by the memory 112 to drive the display panel (not shown) of the LCD monitor to show images corresponding to the pixel data. Please note that operations of the above memory 112 and the source driver 122 are well known to those skilled in this art, and further description is omitted here for the sake of brevity.

In the prior art data accessing system 100, each row of data in the memory 112 is accessed and latched in respective latches 114_1-114_*n* of the buffer unit 114 through transmission lines $a_1$-$a_n$. As mentioned above, if each of the latches 114_1-14_*n* is able to latch one bit, the buffer unit 114 needs 2304 (i.e., n=128*8) latches to latch a complete row of pixel data. Next, each latch in the buffer unit 114 transmits digital data buffered therein to a corresponding latch in the buffer unit 124 of the source device 120 through a transmission line. It should be noted that because the buffer unit 114 in the present example contains 2304 latches, the prior art data accessing system 100 requires 2304 transmission lines (shown by $L_1$-$L_n$ in FIG. 1) coupled between the buffer units 114 and 124. This results in a large routing space needed by the data accessing system 100. Similarly, the buffer unit 124 in the source device 120 also contains latches 124_1-124_*n* of the same number as that of the corresponding latches 114_1-114_*n*. When the latches 124_1-124_*n* have received a complete row of digital data transmitted from the buffer unit 114, the buffer unit 124 transmits the received row of digital data to the source driver 122. The source driver 122 then activates the following image processing according to the received row of digital data, thereby achieving the objective of driving pixels at each scan line of the back-end display panel.

As mentioned above, the prior art LCD display IC requires 2304 transmission lines coupled between the data storage device 110 and the source device 120 to transmit data. In this way, not only is the circuit layout area needed by the LCD display IC increased, but also the cost of routing traces is increased. Furthermore, when data are transmitted via too many transmission lines, the total load of the transmission lines is increased, raising the overall power consumption and degrading the performance of the LCD display IC.

Please refer to FIG. 2. FIG. 2 is a block diagram of a data accessing system 200 in another prior art LCD display IC. The data accessing system 200 includes a memory 212, a memory bus 223 capable of delivering data bits of one pixel per bus cycle, and a source device 220. The source device 220 comprises a source driver 222, a buffer unit 224, and a latch control shift unit 226, wherein the buffer unit 224 includes a plurality of latches 224_1-224_*n* similar to the latches 124_1-124_*n* shown in FIG. 1, and the latch control shift unit 226 includes a plurality of shift registers 226_1-226_*n* used for inputting pixel data outputted from the memory 212 into the buffer unit 224. This prior art scheme is able to eliminate direct traces routed from the memory 212 to the source. However, if there are 128 pixels located at each row, the memory 212 has to be accessed 128 times. That is, the memory array is enabled 128 times, increasing the power consumption greatly.

SUMMARY OF THE INVENTION

According to an embodiment of the claimed disclosure, a data accessing interface coupled between a memory and a source is disclosed. The data accessing interface comprises a multiplex output module and a sequential input module. The multiplex output module is designed for the memory, and includes a buffer unit and a multiplex unit. Suppose that the bit number of each row in the memory is N. The buffer unit is used for storing an N-bit digital data to be outputted from the memory. In addition, the multiplex unit is coupled to the buffer unit for utilizing M multiplexers to select and output the N-bit digital data. The sequential input module is designed for the source, and includes N latches and $$\frac{N}{M}$$

latch control signal is enabled, an M-bit digital data from the multiplex output module is stored into M latches. After all of the latch control signals have been enabled, the N-bit digital data are completely stored into the N latches for the source. Therefore, there are M transmission lines coupled between the memory and the source, i.e., between the sequential input module and the multiplex output module.

In addition, according to an embodiment of the claimed disclosure, a data accessing method applied to a memory of an LCD display IC is disclosed. The data accessing method comprises: (a) outputting an N-bit digital data stored in a row of a memory in each data access operation of the memory, and using a buffer unit to receive the N-bit digital data, wherein this step will enable the memory array and accessing of the memory array becomes a major power consumption operation; (b) controlling a multiplex unit to select an M-bit digital data out of the N-bit digital data stored in the buffer unit by using $$\frac{N}{M}\text{-to-1}$$

multiplexers and then output the M-bit digital data, wherein this step does not enable the memory array and only the multiplexers are consuming power; (c) repeatedly outputting an M-bit digital data through the multiplex unit, and after $$\frac{N}{M}$$

times, all of the N-bit digital data stored in a row are completely outputted. The disclosed method only enables the memory array in step (a), reducing power consumption greatly.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
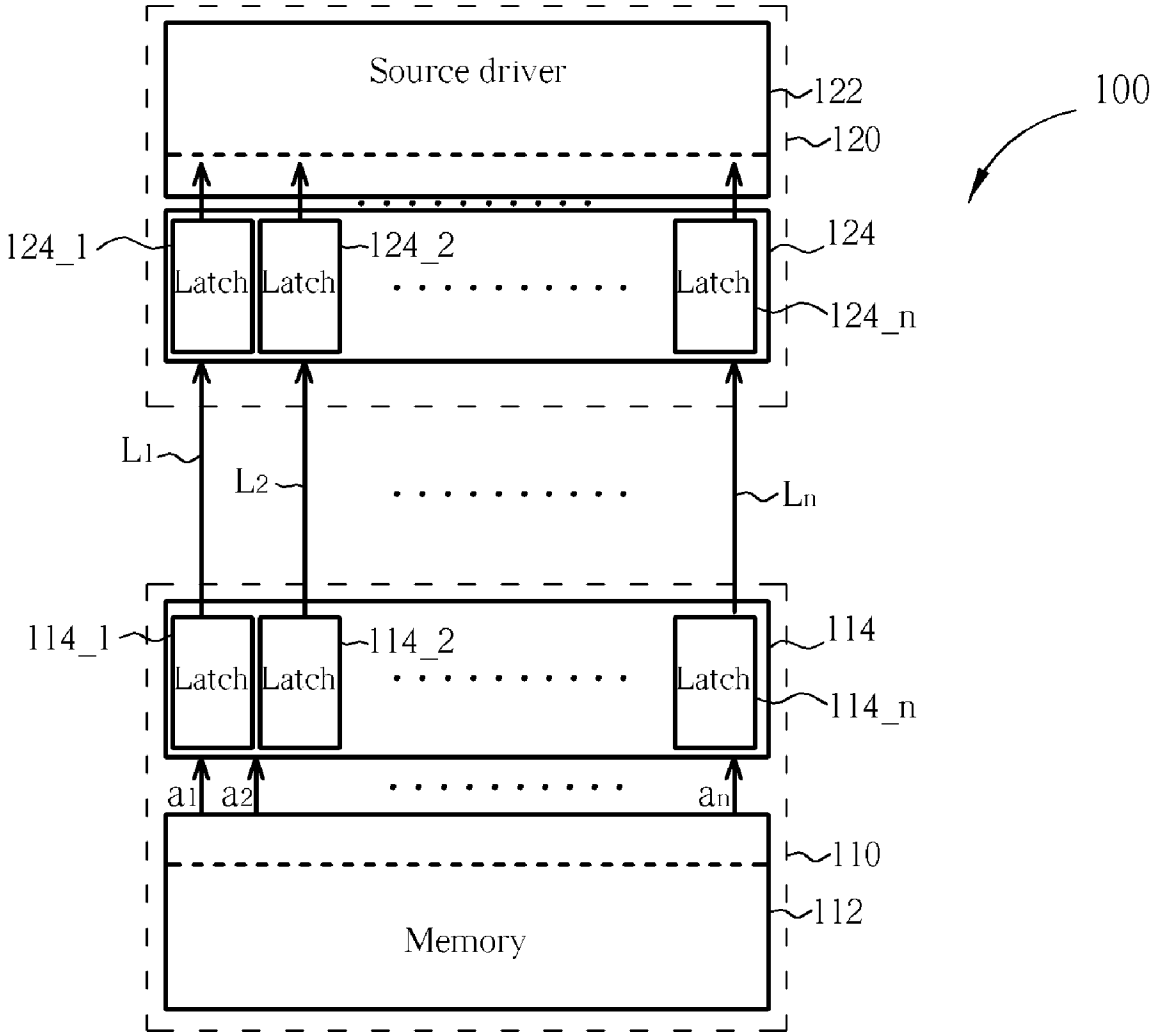
Fig. 1 Prior Art
FIG. 1 is a block diagram of a data accessing system in one prior art LCD display IC.
Figure 3:
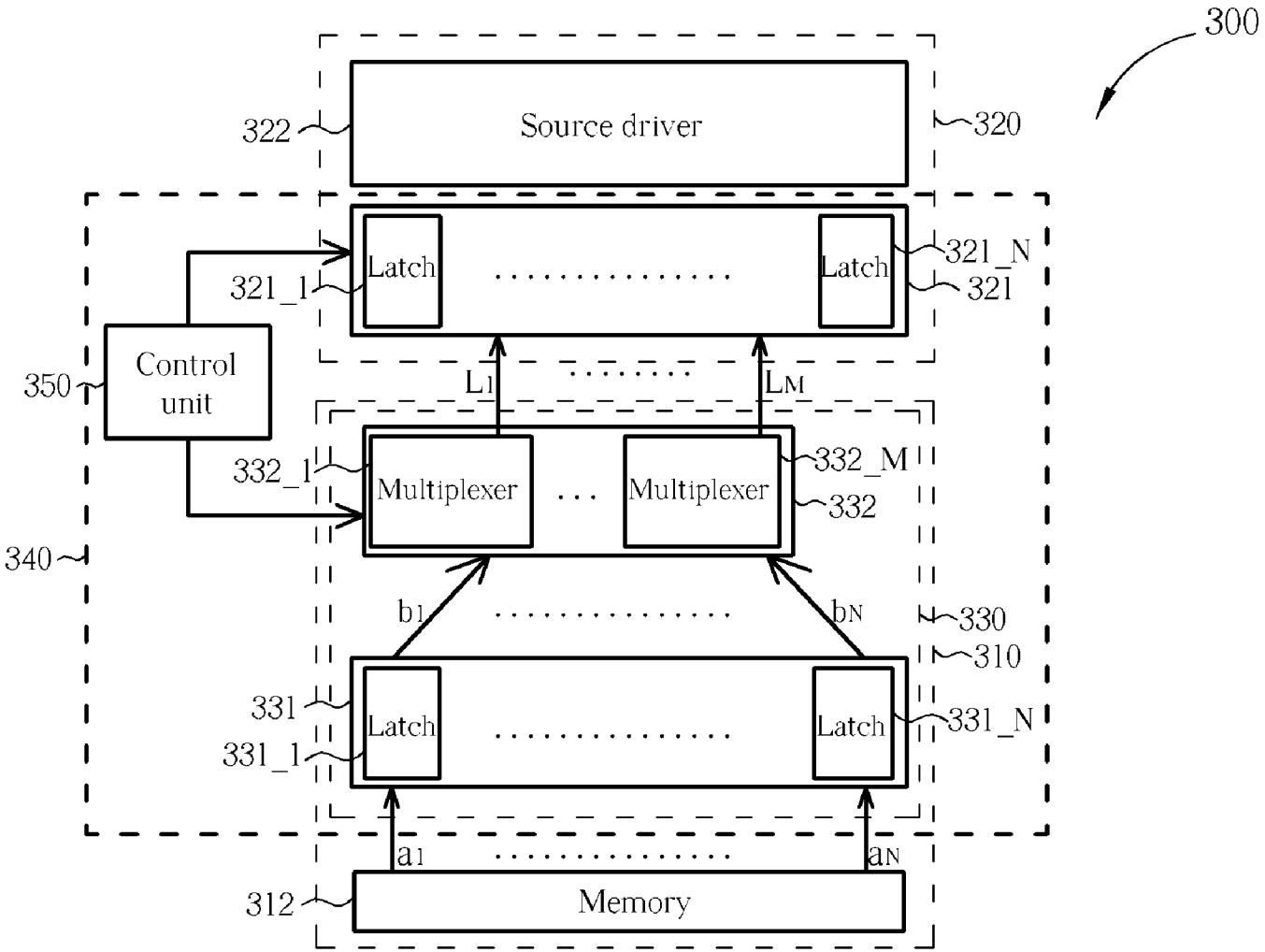
FIG. 3 is a data accessing system according to an embodiment of the present invention.

Please refer to FIG. 3. FIG. 3 is a data accessing system 300 according to an embodiment of the present invention. In this embodiment, the data accessing system 300 comprises a data storage device 310, a source device 320, and a control unit 350. The data storage device 310 includes a memory 312 and a multiplex output module 330, wherein the source device 320 has a source driver 322 and a sequential input module 321. The multiplex output module 330 includes a buffer unit 331 and a multiplex unit 332, and the sequential input module 321 comprises a plurality of latches 321_1-321_N and $$\frac{N}{M}$$

latch control signals. Additionally, the buffer unit 331 includes a plurality of latches 331_1-331_N, and the multiplex unit 332 includes a plurality of multiplexers 332_1-332_M. Please note that since the components of the same name in the devices shown in FIG. 3 and FIG. 1 have the same functionality and operation, further description is omitted here for the sake of brevity.

The data accessing interface 340 consisted of the multiplex output module 330, the sequential input module 321 and the control unit 350 establishes a main frame of the present invention. In this embodiment, suppose that each row of the memory 312 stores digital data (i.e., pixel data) corresponding to 128 pixels, and digital data of each pixel contain 18 (i.e., 6*3) bits where the gray level of each color component R, G, B is represented by 6 bits. The bit number of each row in the memory 212 is 2304 (i.e., 128*18). In other words, a complete row of pixel data in the memory 212 is accessed and latched by respective latches 331_1-331_N of the buffer unit 331 through transmission lines $a_1$-$a_N$, where N=2304 in this embodiment of the present invention. Next, after the data are fully gathered, the latches 331_1-331_N of the buffer unit 331 transfer data buffered therein to the multiplex unit 332 through transmission lines $b_1$-$b_N$, where N=2304 in this embodiment of the present invention.

Please note that the multiplex unit 332 in this embodiment of the present invention contains a plurality of multiplexers 332_1-332_M, where the multiplexer number M is determined according to the number of input nodes of each multiplexer and the number of latches in the buffer unit 331. For example, if the number of latches N in the buffer unit 331 is equal to 2304 (i.e., N=18*128), and 6-to-1 multiplexers each having 6 input nodes and one output node are implemented, the multiplexer number M of the multiplex unit 332 is equal to 384 (i.e., M=2304/6). The multiplexers 332_1-332_M then transfer digital data buffered therein to the source device 320 through transmission lines $L_1$-$L_M$, where M=384 in this embodiment of the present invention.

Figure 4:
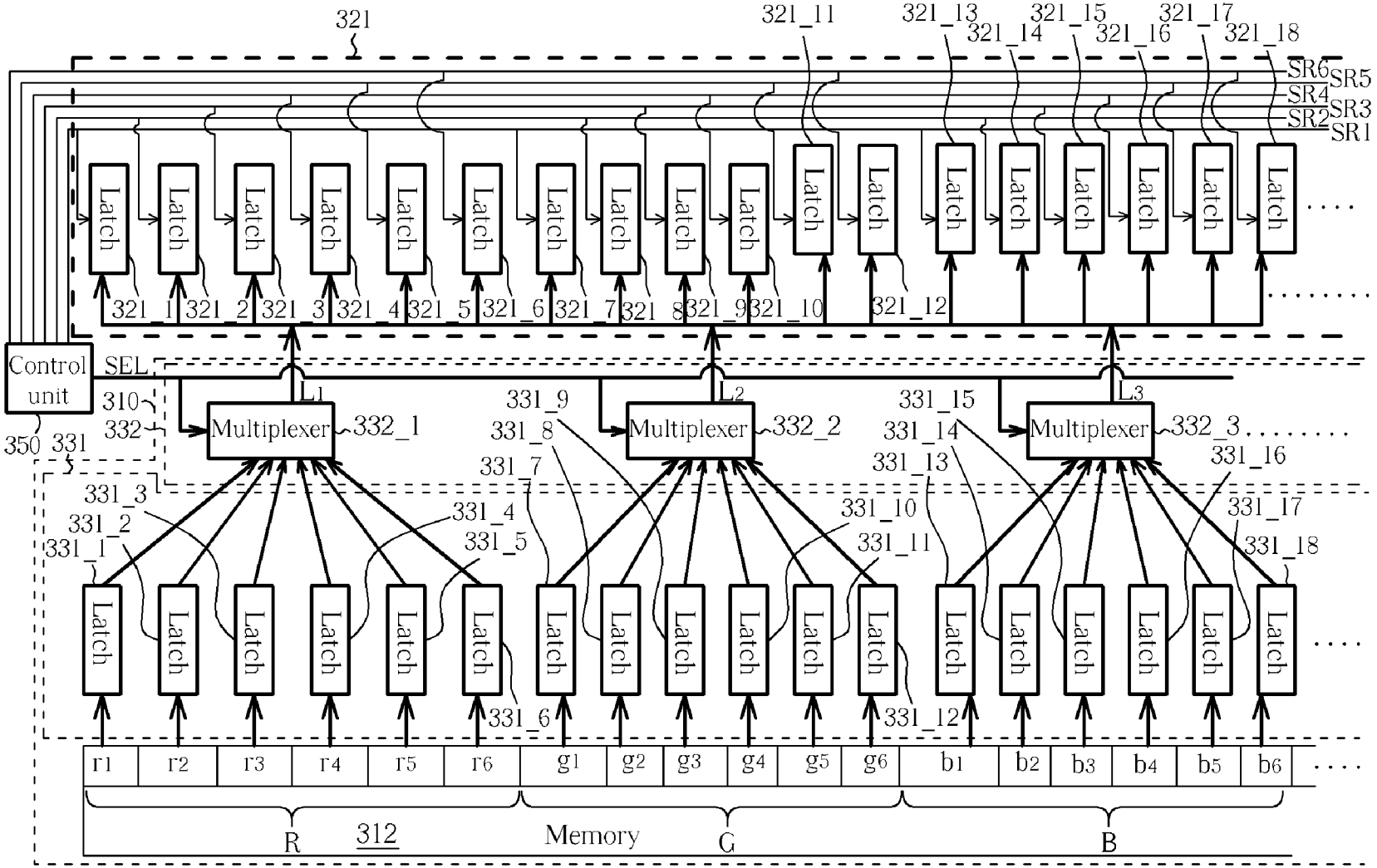
FIG. 4 is a diagram of a detailed configuration of the data accessing interface shown in FIG. 3.

To further illustrate operations of the data accessing interface 340 in this embodiment of the present invention, the transmission of pixel data in the memory 312 that are associated with the first pixel is taken as an example hereinafter. Please refer to FIG. 4. FIG. 4 is a diagram of a detailed configuration of the data accessing interface 340 shown in FIG. 3. Suppose that digital data of each color component R, G, or B corresponding to each pixel contain 6 bits stored in the memory 312. As to the first pixel shown in FIG. 4, the data bits representative of the gray level of the color component R are r1-r6, the data bits representative of the gray level of the color component G are g1-g6, and the data bits representative of the gray level of the color component B are b1-b6. As mentioned above, these data bits of the first pixel are respectively stored in corresponding latches 331_1-331_18. In this embodiment of the present invention, the multiplexer 332_1 in the multiplex unit 332 is used for receiving data bits r1-r6 corresponding to the color component R of the first pixel; the multiplexer 332_2 in the multiplex unit 332 is used for receiving data bits g1-g6 corresponding to the color component G of the first pixel; and the multiplexer 332_3 in the multiplex unit 332 is used for receiving data bits b1-b6 corresponding to the color component B of the first pixel. The control unit 350 then outputs multiplex selection signal SEL to control the multiplexers 332_1-332_3 to sequentially output data bits of the first pixel to the sequential input module 321 of the source, and enables corresponding latch control signals SR1-SR6 to store the received data bits into corresponding latches. For example, when the multiplex selection signal SEL selects the first bit, the multiplexers 332_1-332_3 receive a first bit address data to transmit data bits r1, g1, b1 to the transmission lines $L_1$, $L_2$, $L_3$, respectively; and when the multiplex selection signal SEL selects the second bit, the multiplexers 332_1-332_3 receive a second bit address data to transmit data bits r2, g2, b2 to the transmission lines $L_1$, $L_2$, $L_3$, respectively. The aforementioned operation is repeated for following bits until all of the data bits r1-r6, g1-g6, b1-b6 are completely transmitted. At this moment, the operation of transmitting the data bits latched in the memory 312 is completed. In this case, the multiplex output module 330 of the present invention utilizes one layer of buffer unit 331 and a multiplex unit 332 to make the number of transmission lines become one sixth of the original value. That is, conventional data accessing system needs 18 transmission lines to transmit data bits of the first pixel; however, the data accessing system 300 of the present invention needs 3 transmission lines only to achieve the same objective of transmitting data bits of the first pixel. In this way, the transmission line layout area required by the data accessing system is greatly reduced.

It should be noted that the pixel data transmission mechanism shown in FIG. 3 is only one exemplary embodiment of the present invention, and is not meant to be a limitation of the present invention. For example, in another embodiment of the present invention, 6 input nodes of the multiplexer 332_1 are connected to latches 331_1, 331_2, 331_7, 331_8, 331_13, 331_14 respectively, 6 input nodes of the multiplexer 332_2 are connected to latches 331_3, 331_4, 331_9, 331_10, 331_15, 331_16 respectively, and 6 input nodes of the multiplexer 332_1 are connected to latches 331_5, 331_6, 331_11, 331_12, 331_17, 331_18 respectively. With an adequate control of the control unit 350, the same objective of transmitting data bits in multiple cycles is achieved.

Figure 5:
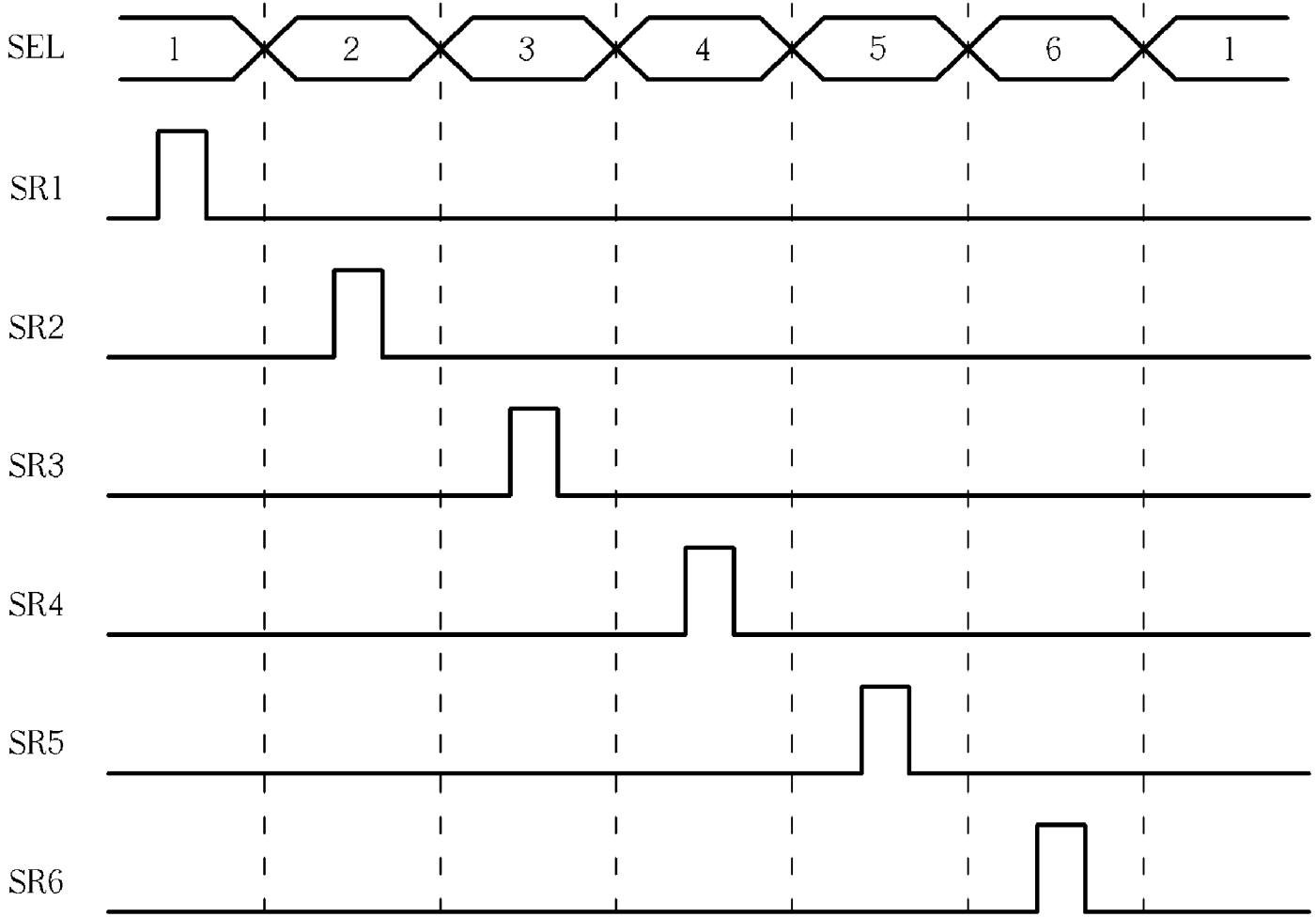
FIG. 5 is a timing diagram of signals generated from a control unit shown in FIG. 3.

Referring to FIG. 4 again, in the sequential input module 321, the transmission line $L_1$ is connected to input nodes of 6 latches 321_1-321_6, the transmission line $L_2$ is connected to input nodes of 6 latches 321_7-321_12, and the transmission line $L_3$ is connected to input nodes of 6 latches 321_13-321_18. When the multiplexers 332_1, 332_2, 332_3 output data bits r1, g1, b1, the control unit 350 enables the latch control signal SR1 to store data bits r1, g1, b1 into latches 321_1, 321_7, 321_13 respectively. Later, when the multiplexers 332_1, 332_2, 332_3 output data bits r2, g2, b2, the control unit 350 enables the latch control signal SR2 to store data bits r2, g2, b2 into latches 321_2, 321_8, 321_14 respectively. The aforementioned data latching operation is repeated for processing remaining data bits until final data bits r6, g6, b6 are stored into latches 321_6, 321_12, 321_18, respectively. In this embodiment, the timing diagram of the signals generated from the control unit 350 is illustrated in FIG. 5. At this moment, the source driver 322 then activates the following image processing according to the received row of digital data stored in the buffer unit 321, thereby driving pixels at each scan line of the back-end display panel to show corresponding images.

Figure 6:
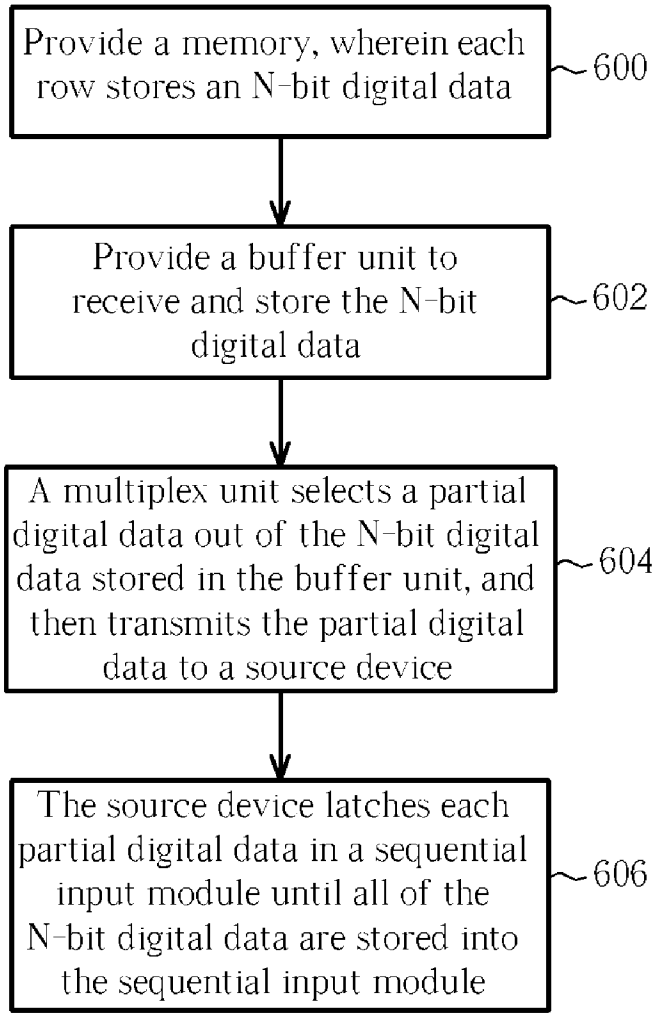
FIG. 6 is a flowchart illustrating a method of using the data accessing system shown in FIG. 3 to deliver data bits through a data accessing interface according to an embodiment of the present invention.

Please refer to FIG. 6. FIG. 6 is a flowchart illustrating a method of using the data accessing system 300 to deliver data bits through the data accessing interface 340 according to an embodiment of the present invention. Suppose that the result is substantially the same. The steps shown in the flowchart are not limited to be executed in the exact order. Additionally, other steps can be inserted. The method includes following steps:

Step 600: Provide a data access device 310 including a memory 312, wherein each row of a memory array in the memory 312 stores an N-bit digital data;

Step 602: Provide a buffer unit 331 to receive and store the N-bit digital data outputted from the memory 312;

Step 604: The multiplex unit 332 selects an M-bit digital data out of the N-bit digital data stored in the buffer unit 331, and then transmits the M-bit digital data to a source device 320. In this way, the number of transmission lines coupled between the data storage device 310 and the source device 320 is reduced;

Step 606: The sequential input module 321 in the source device 320 utilizes a latch control signal to store the M-bit digital data into M latches, and then sequentially enables $$\frac{N}{M}$$

latch control signals to thereby completely store the N-bit digital data into the sequential input module 321.

It should be noted that in the above embodiment the multiple unit 332 is implemented using 6-to-1 multiplexers each having 6 input nodes and one output node; however, in other embodiments, multiplexers of different types can be adopted, for example, 8-to-1 multiplexers. Generally speaking, the implemented multiplexers each having more output nodes are capable of saving more transmission line routing space. However, the processing time required to complete transmitting all of the pixel data becomes longer accordingly. Therefore, the present invention can select proper multiplexers according to desired design requirements. Furthermore, the above embodiment uses a transmission line to connect the output node of a multiplexer to input nodes of 6 latches in the sequential input module, and uses 6 latch control signals to control data storage of inputted data bits. Not only is the transmission line routing space reduced, but also the inputted data bits can be correctly latched. In other embodiments, it is possible to use latches of a different number (e.g., 8) to work with a single multiplexer. These alternative designs all fall in the scope of the present invention.

Figure 2:
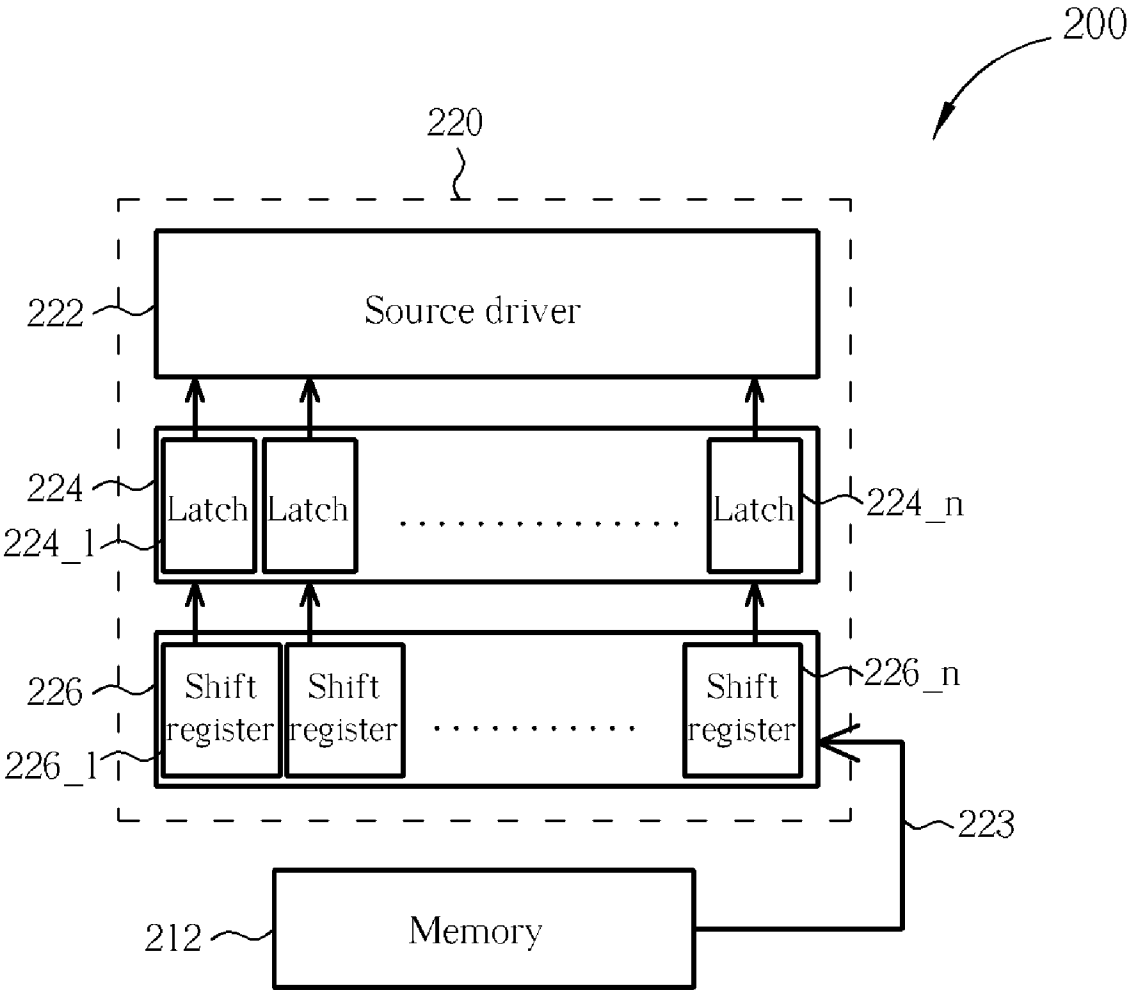
Fig. 2 Prior Art
FIG. 2 is a block diagram of a data accessing system in another prior art LCD display IC.

According to above description, it can be readily understood that the multiplex output module 330 utilizes a single-level buffer unit 331 and a multiplex unit 332 to greatly reduce the number of transmission lines originally required for transmitting data bits from the memory 312 to the source driver 322. Comparing transmission line numbers of the present invention and the prior art, the prior art data accessing system 100 shown in FIG. 1 needs 2304 transmission lines to deliver data bits, while the data accessing system 300 of the present invention merely needs 384 transmission lines to deliver data bits. The data accessing system of the present invention therefore is capable of saving the routing space of an LCD display IC and the production cost thereof. Additionally, the magnitude of peak current is lowered due to fewer implemented transmission lines. In this way, the overall power consumption is reduced, thereby improving the performance of the LCD display IC. Compared with the prior art data accessing system 200 shown in FIG. 2 that requires accessing the memory 128 times, the data accessing system 300 of the present invention only accesses the memory once. Please note that there is no need to access the memory when using the multiplex unit to transmit data bits. Therefore, the power consumption is greatly reduced. When the data accessing system 300 of the present invention has to operate under a low supply voltage if fabricated using an advanced semiconductor process, the number of times of accessing the memory can be increased to 2 or 4. However, the power consumption in such a case is still far lower than that of the prior art.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A data accessing interface coupled between a memory and a source, comprising:

a multiplex output module, for outputting M bits of an N-bit digital data in each multiplexing operation to thereby output the N-bit digital data, wherein M and N are both positive integers, M is less than N, and $$\frac{N}{M}$$

is a positive integer; and a sequential input module, for sequentially latching data transmitted through M transmission lines to store the N-bit digital data;

wherein the multiplex output module comprises:

a buffer unit, for receiving the N-bit digital data from a complete row of the memory; and a multiplex unit, coupled to the buffer unit, for selecting an M bit digital data out of a plurality of M-bit digital data comprised of the N-bit digital data stored in the buffer unit in each multiplexing operation and then outputting the plurality of M-bit digital data one by one, thereby outputting the N-bit digital data.

2. The data accessing interface of claim 1, wherein the multiplex unit comprises M multiplexers, and $$\frac{N}{M}$$

input nodes of each multiplexer are coupled to $$\frac{N}{M}$$

specific latches in the buffer unit, respectively.

3. The data accessing interface of claim 1, further comprising:

a control unit, coupled to the multiplex output module, for outputting a multiplex selection signal to the multiplex unit to control the multiplex unit to select an M-bit digital data out of the N-bit digital data periodically.

4. The data accessing interface of claim 1, wherein the sequential input module comprises N latches, M input ports, and $$\frac{N}{M}$$

latch control signals.

5. The data accessing interface of claim 4, wherein when a first latch control signal is enabled, an M-bit digital data is stored into M latches through the M input ports; and remaining latch control signals are enabled sequentially to make all of the N-bit digital data stored into the N latches.

6. The data accessing interface of claim 1, further comprising:

a control unit, for outputting a multiplex selection signal to the multiplex output module to control the multiplex output module to select an M-bit digital data out of the N-bit digital data periodically and for outputting $$\frac{N}{M}$$

latch control signals to the sequential input module to control data latching of the sequential input module.

7. A data accessing method applied to a memory of an LCD display IC, comprising:

(a) providing a buffer unit in the memory for buffering an N-bit digital to be outputted in a row of the memory;

(b) utilizing a multiplexer to select an M-bit digital data out of the N-bit digital data stored in the buffer unit and then output the M-bit digital data; and (c) repeatedly utilizing the multiplexer to output an M-bit digital data in each multiplexing operation until the number of times of outputting an M-bit digital data is equal to $$\frac{N}{M},$$

thereby completely outputting the N-bit digital data stored in the row of the memory, wherein M and N are both positive integers, M is less than N, and $$\frac{N}{M}$$

is a positive integer.

8. The data accessing method of claim 7, wherein step (b) further comprises:

selecting an M-bit digital data out of the N-bit digital data in each multiplexing operation.

* * * * *